US010953287B2

(12) United States Patent
Watanabe et al.

(10) Patent No.: US 10,953,287 B2
(45) **Date of Patent: *Mar. 23, 2021**

(54) MULTI-PIECE SOLID GOLF BALL

(71) Applicant: Bridgestone Sports Co., Ltd., Tokyo (JP)

(72) Inventors: Hideo Watanabe, Saitamaken (JP); Masanobu Kuwahara, Saitamaken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/799,335

(22) Filed: Feb. 24, 2020

(65) Prior Publication Data

US 2020/0206580 A1 Jul. 2, 2020

Related U.S. Application Data

(63) Continuation-in-part of application No. 16/375,962, filed on Apr. 5, 2019, now Pat. No. 10,610,741.

(30) Foreign Application Priority Data

May 16, 2018 (JP) ..... 2018-094620

(51) Int. Cl.
*A63B 37/06* (2006.01)
*A63B 37/00* (2006.01)

(52) U.S. Cl.
CPC ..... *A63B 37/0092* (2013.01); *A63B 37/0031* (2013.01); *A63B 37/0043* (2013.01); *A63B 37/0062* (2013.01); *A63B 37/0075* (2013.01)

(58) Field of Classification Search
CPC ..... A63B 37/0063; A63B 37/0062
USPC ..... 473/371
See application file for complete search history.

(56) References Cited

U.S. PATENT DOCUMENTS

| | | | |
|---|---|---|---|
| 6,679,791 | B2 | 1/2004 | Watanabe |
| 9,855,466 | B2 | 1/2018 | Watanabe et al. |
| 9,873,024 | B2 | 1/2018 | Kimura et al. |
| 9,889,342 | B2 | 2/2018 | Kimura et al. |
| 10,046,207 | B2 | 8/2018 | Watanabe et al. |
| 10,124,215 | B2 | 11/2018 | Nakajima et al. |

(Continued)

FOREIGN PATENT DOCUMENTS

| | | | |
|---|---|---|---|
| JP | 2002-000765 | A | 1/2002 |
| JP | 2015-047502 | A | 3/2015 |
| JP | 2015-077405 | A | 4/2015 |

(Continued)

*Primary Examiner* — Raeann Gorden
(74) *Attorney, Agent, or Firm* — Sughrue Mion, PLLC

(57) ABSTRACT

In a golf ball having a core, an intermediate layer and a cover, the intermediate layer-encased sphere has a higher surface hardness than the ball. The core hardness profile in the ball is designed such that the core surface has a Shore C hardness value which is at least 27 higher than the Shore C hardness value at the core center, and the surface areas A to F calculated from hardness differences between positions located at specific distances in the core and differences between the specific distances satisfy a specific formula. This golf ball has an excellent flight performance when struck by skilled amateur golfers and professionals, and also has a good controllability on shots with an iron.

7 Claims, 2 Drawing Sheets

(56) References Cited

U.S. PATENT DOCUMENTS 10,610,741 B2 * 4/2020 Watanabe ..... A63B 37/0019

FOREIGN PATENT DOCUMENTS

| | | | |
|---|---|---|---|
| JP | 2016-112308 | A | 6/2016 |
| JP | 2017-077355 | A | 4/2017 |

* cited by examiner

MULTI-PIECE SOLID GOLF BALL

CROSS-REFERENCE TO RELATED APPLICATION

This application is a continuation-in-part of copending application Ser. No. 16/375,962 filed on Apr. 5, 2019, the entire contents of which are hereby incorporated by reference.

TECHNICAL FIELD

This invention relates to a multi-piece solid golf ball composed of three or more layers that include a core, an intermediate layer and a cover.

BACKGROUND ART

Numerous innovations have hitherto been introduced in designing golf balls with a multilayer construction and many such balls have been developed to satisfy the needs of professional golfers and skilled amateurs. For example, functional multi-piece solid golf balls in which the surface hardnesses of the respective layers—i.e., the core, intermediate layer and cover (outermost layer)—have been optimized are widely used.

Examples of such multi-piece solid golf balls include those disclosed in JP-A 2002-765, JP-A 2016-112308, JP-A 2015-77405, JP-A 2015-47502, JP-A 2017-77355 and U.S. Pat. No. 9,855,466. However, these are golf balls having a specified core hardness profile and specified surface hardnesses for the respective layer-encased spheres. As golf balls for professional golfers and skilled amateurs, there remains room for further improvement in terms of, for example, achieving an even better flight performance and obtaining a good controllability on approach shots.

SUMMARY OF THE INVENTION

It is therefore an object of the present invention to provide a multi-piece solid golf ball for professional golfers and skilled amateurs, which ball has an excellent flight performance when struck by high head speed golfers such as skilled amateurs and professionals and also has a good controllability in the short game when hit using an iron.

As a result of extensive investigations, we have discovered that, in a multi-piece solid golf ball having a core, an intermediate layer and a cover, by specifying the relationship between the surface hardness of the sphere consisting of the core encased by the intermediate layer and the surface hardness of the ball and by designing the core hardness profile such that, setting the hardness values of positions located specific distances from a midpoint M between the center and surface of the core toward the surface side of the core and the hardness values of positions located specific distances from the midpoint M toward the center side of the core and calculating in the manner described below surface areas A to F from hardness differences between the positions and differences between the specific distances, these surface areas A to F satisfy a specific formula, a golf ball can be obtained which has an excellent flight performance when struck by high head speed golfers such as skilled amateurs and professionals and which also has a good controllability in the short game when hit using an iron.

Accordingly, the invention provides a multi-piece solid golf ball which has a core, an intermediate layer and a cover, wherein the sphere obtained by encasing the core with the intermediate layer (intermediate layer-encased sphere) has a higher surface hardness than the ball. The core has a hardness profile in which, letting Cc be the Shore C hardness at the center of the core and Cs be the Shore C hardness at the core surface, the hardness difference between the core surface and center (Cs−Cc), expressed in terms of Shore C hardness, is at least 27 and, letting $C_M$ be the Shore C hardness at a midpoint M between the core center and surface, $C_{M+2.5}$, $C_{M+5.0}$ and $C_{M+7.5}$ be the Shore C hardnesses at, respectively, positions 2.5 mm, 5.0 mm and 7.5 mm from the midpoint M toward the core surface side, and $C_{M-2.5}$, $C_{M-5.0}$ and $C_{M-7.5}$ be the Shore C hardnesses at, respectively, positions 2.5 mm, 5.0 mm and 7.5 mm from the midpoint M toward the core center side, the surface areas A to F defined as follows $$\text{surface area } A\text{: } \tfrac{1}{2}\times 2.5\times(C_{M-5.0}-C_{M-7.5}),$$

$$\text{surface area } B\text{: } \tfrac{1}{2}\times 2.5\times(C_{M-2.5}-C_{M-5.0}),$$

$$\text{surface area } C\text{: } \tfrac{1}{2}\times 2.5\times(C_{M}-C_{M-2.5}),$$

$$\text{surface area } D\text{: } \tfrac{1}{2}\times 2.5\times(C_{M+2.5}-C_{M}),$$

$$\text{surface area } E\text{: } \tfrac{1}{2}\times 2.5\times(C_{M+5.0}-C_{M+2.5}),$$

$$\text{surface area } F\text{: } \tfrac{1}{2}\times 2.5\times(C_{M+7.5}-C_{M+5.0}),$$

satisfy the conditions $$(\text{surface area } D+\text{surface area } E)-(\text{surface area } A+\text{surface area } B+\text{surface area } C)\geq 1,$$

and $$\text{surface area } C<\text{surface area } D<\text{surface area } E.$$

In a preferred embodiment of the golf ball of the invention, the surface areas A to F in the core hardness profile satisfy the condition $$(\text{surface area } D+\text{surface area } E+\text{surface area } F)-(\text{surface area } A+\text{surface area } B+\text{surface area } C)\geq 10.$$

In another preferred embodiment, the surface areas A to F in the core hardness profile satisfy the condition $$0.40\leq[(\text{surface area } D+\text{surface area } E+\text{surface area } F)-(\text{surface area } A+\text{surface area } B+\text{surface area } C)]/(Cs-Cc)\leq 0.85.$$

In yet another preferred embodiment, the surface areas B to E in the core hardness profile satisfy the condition $$\text{surface area } B\leq\text{surface area } C<\text{surface area } D<\text{surface area } E.$$

In still another preferred embodiment, the core is a single layer made of a rubber material.

In a further preferred embodiment, a paint film layer is formed on the cover surface and, letting Hc be the Shore C hardness of the paint film layer, the difference between the Shore C hardness $C_M$ at the midpoint M between the core center and surface and Hc ($C_M$−Hc) is 0 or more.

In a still further preferred embodiment, the cover has a plurality of dimples formed on a surface thereof, the ball has arranged thereon at least one dimple with a cross-sectional shape that is described by a curved line or a combination of straight and curved lines and specified by steps (i) to (iv) below, and the total number of dimples is from 250 to 380:

(i) letting the foot of a perpendicular drawn from a deepest point of the dimple to an imaginary plane defined by a peripheral edge of the dimple be the dimple center and a straight line that passes through the dimple center and any one point on the edge of the dimple be the reference line;

(ii) dividing a segment of the reference line from the dimple edge to the dimple center into at least 100 points and computing the distance ratio for each point when the distance from the dimple edge to the dimple center is set to 100%;

(iii) computing the dimple depth ratio at every 20% from 0 to 100% of the distance from the dimple edge to the dimple center; and (iv) at the depth ratios in dimple regions 20 to 100% of the distance from the dimple edge to the dimple center, determining the change in depth ΔH every 20% of said distance and designing a dimple cross-sectional shape such that the change ΔH is at least 6% and not more than 24% in all regions corresponding to from 20 to 100% of said distance.

Advantageous Effects of the Invention

The multi-piece solid golf ball of the invention is able to lower the spin rate on full shots with a driver when played by golfers having a high head speed, such as skilled amateur golfers and professionals, and moreover can reliably achieve a good distance when hit with a middle iron. Together with having an excellent flight performance, the ball also is endowed with a good controllability in the short game when hit using an iron, and thus is highly suitable as a golf ball for professional golfers and skilled amateurs.

BRIEF DESCRIPTION OF THE DIAGRAMS

Figure 3A:
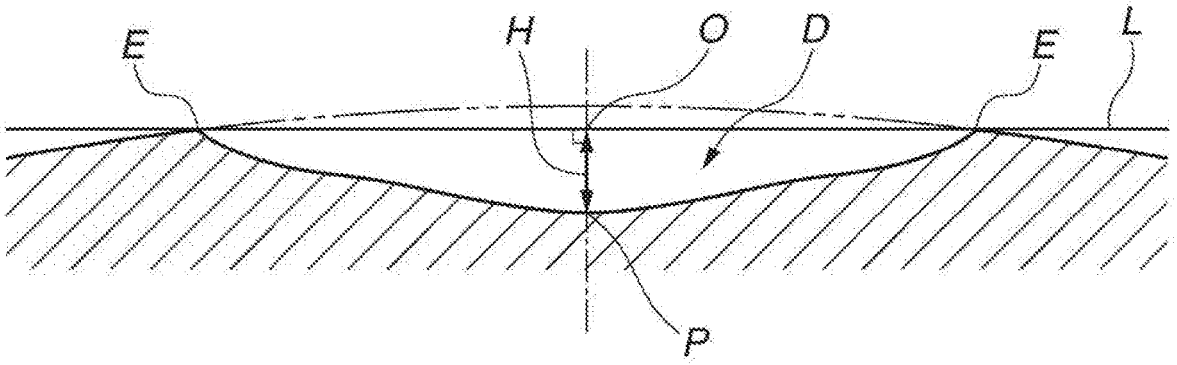
Figure 3B:
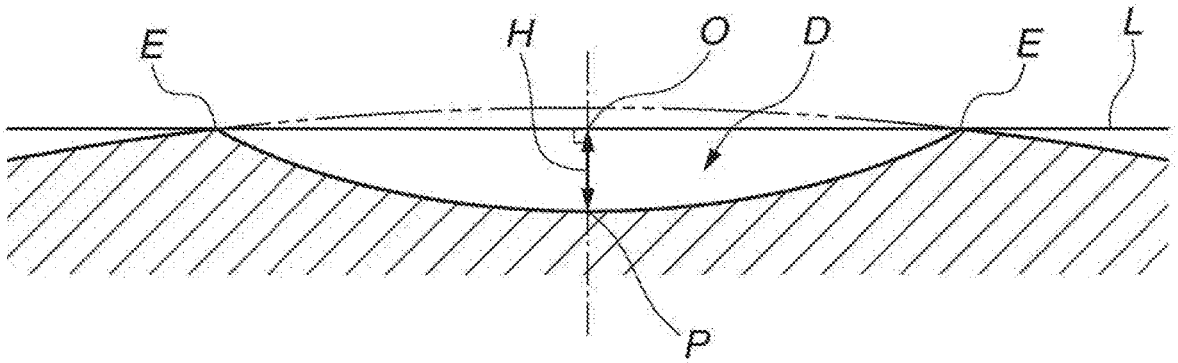

FIG. 3 presents schematic cross-sectional views of dimples used in the Working Examples and Comparative Examples, FIG. 3A showing a dimple having a distinctive cross-sectional shape and FIG. 3B showing a dimple having a circularly arcuate cross-sectional shape.

DESCRIPTION OF THE PREFERRED EMBODIMENTS

The objects, features and advantages of the invention will become more apparent from the following detailed description taken in conjunction with the appended diagrams.

Figure 1:
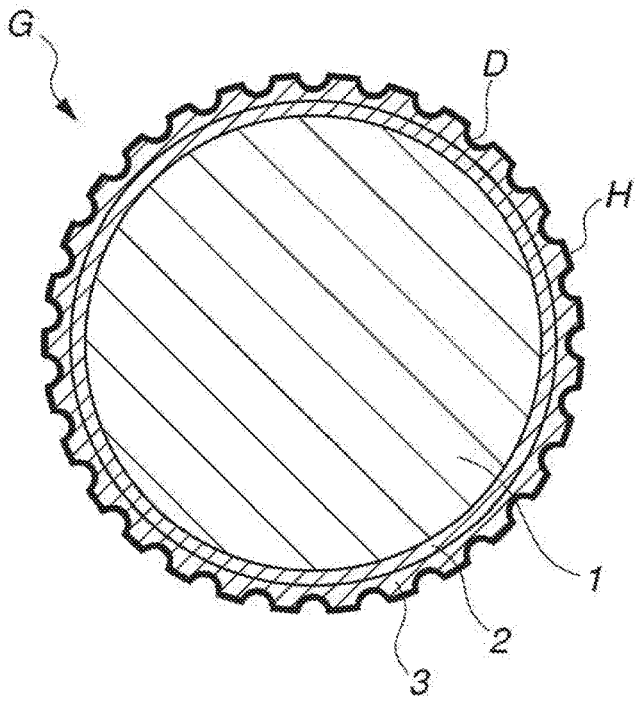
FIG. 1 is a schematic cross-sectional view of a multi-piece solid golf ball according to one embodiment of the invention.

The multi-piece solid golf ball of the invention has a core, an intermediate layer and a cover. Referring to FIG. 1, which shows an embodiment of the inventive golf ball, the ball G has a core 1, an intermediate layer 2 encasing the core 1, and a cover 3 encasing the intermediate layer 2. The cover 3, excluding a paint film layer, is positioned as the outermost layer in the layered construction of the ball. In this invention, the intermediate layer may be a single layer or may be formed of two or more layers. Numerous dimples D are typically formed on the surface of the cover (outermost layer) 3 so as to enhance the aerodynamic properties of the ball. A paint film layer H is formed on the surface of the cover 3. Each layer is described in detail below.

The core in this invention may consist of a single layer or may consist of two layers: an inner core layer and an outer core layer. From the standpoint of holding down production costs, a single-layer core is preferred.

The core diameter is preferably at least 36.9 mm, more preferably at least 37.7 mm, and even more preferably at least 38.5 mm. The upper limit is preferably not more than 40.5 mm, more preferably not more than 39.8 mm, and even more preferably not more than 39.3 mm. When the core diameter is too small, the spin rate on shots with a driver (W #1) may rise or the ball rebound may be low, as a result of which the intended distance may not be achieved. On the other hand, when the core diameter is too large, the durability to repeated impact may worsen, or the spin rate on shots with a driver (W #1) may rise, as a result of which the intended distance may not be achieved.

The core has a deflection (mm) when compressed under a final load of 1,275 N (130 kgf) from an initial load of 98 N (10 kgf) which, although not particularly limited, is preferably at least 2.6 mm and preferably not more than 4.2 mm. When the core deflection is too large, i.e., when the core is too soft, the feel at impact may be too soft, the durability to repeated impact may worsen, or the initial velocity on full shots may be low, as a result of which the intended distance may not be achieved. On the other hand, when the core deflection is too small, i.e., when the core is too hard, the feel at impact may be too hard, or the spin rate on full shots may be high, as a result of which the intended distance may not be achieved.

It is desirable for the core material to be composed primarily of a rubber material. Specifically, a core-forming rubber composition can be prepared by using a base rubber as the chief component and including, together with this, other ingredients such as a co-crosslinking agent, an organic peroxide, an inert filler and an organosulfur compound. It is preferable to use polybutadiene as the base rubber.

Commercial products may be used as the polybutadiene. Illustrative examples include BR01, BR51 and BR730 (from JSR Corporation). The proportion of polybutadiene within the base rubber is at least 60 wt %, and preferably at least 80 wt %. Rubber ingredients other than the above polybutadienes may be included in the base rubber, provided that doing so does not detract from the advantageous effects of the invention. Examples of rubber ingredients other than the above polybutadienes include other polybutadienes and also other diene rubbers, such as styrene-butadiene rubbers, natural rubbers, isoprene rubbers and ethylene-propylene-diene rubbers.

Examples of co-crosslinking agents include unsaturated carboxylic acids and the metal salts of unsaturated carboxylic acids. Specific examples of unsaturated carboxylic acids include acrylic acid, methacrylic acid, maleic acid and fumaric acid. The use of acrylic acid or methacrylic acid is especially preferred. Metal salts of unsaturated carboxylic acids include, without particular limitation, the above unsaturated carboxylic acids that have been neutralized with desired metal ions. Specific examples include the zinc salts and magnesium salts of methacrylic acid and acrylic acid. The use of zinc acrylate is especially preferred.

The unsaturated carboxylic acid and/or metal salt thereof is included in an amount, per 100 parts by weight of the base rubber, which is typically at least 5 parts by weight, preferably at least 10 parts by weight, and more preferably at least 20 parts by weight. The amount included is typically not more than 60 parts by weight, preferably not more than 50 parts by weight, more preferably not more than 40 parts by weight, and most preferably not more than 30 parts by weight. Too much may make the core too hard, giving the ball an unpleasant feel at impact, whereas too little may lower the rebound.

Commercial products may be used as the organic peroxide. Examples of such products that may be suitably used include Percumyl D, Perhexa C-40 and Perhexa 3M (all from NOF Corporation), and Luperco 231XL (from AtoChem Co.). One of these may be used alone, or two or more may be used together. The amount of organic peroxide included per 100 parts by weight of the base rubber is preferably at least 0.1 part by weight, more preferably at least 0.3 part by weight, even more preferably at least 0.5 part by weight, and most preferably at least 0.6 part by weight. The upper limit is preferably not more than 5 parts by weight, more preferably not more than 4 parts by weight, even more preferably not more than 3 parts by weight, and most preferably not more than 2.5 parts by weight. When too much or too little is included, it may not be possible to obtain a ball having a good feel, durability and rebound.

Another compounding ingredient typically included with the base rubber is an inert filler, preferred examples of which include zinc oxide, barium sulfate and calcium carbonate. One of these may be used alone, or two or more may be used together. The amount of inert filler included per 100 parts by weight of the base rubber is preferably at least 1 part by weight, and more preferably at least 5 parts by weight. The upper limit is preferably not more than 50 parts by weight, more preferably not more than 40 parts by weight, and even more preferably not more than 35 parts by weight. Too much or too little inert filler may make it impossible to obtain a proper weight and a suitable rebound.

In addition, an antioxidant may be optionally included. Illustrative examples of suitable commercial antioxidants include Nocrac NS-6 and Nocrac NS-30 (both available from Ouchi Shinko Chemical Industry Co., Ltd.), and Yoshinox 425 (available from Yoshitomi Pharmaceutical Industries, Ltd.). One of these may be used alone, or two or more may be used together.

The amount of antioxidant included per 100 parts by weight of the base rubber is set to preferably 0 part by weight or more, more preferably at least 0.05 part by weight, and even more preferably at least 0.1 part by weight. The upper limit is set to preferably not more than 3 parts by weight, more preferably not more than 2 parts by weight, even more preferably not more than 1 part by weight, and most preferably not more than 0.5 part by weight. Too much or too little antioxidant may make it impossible to achieve a suitable ball rebound and durability.

An organosulfur compound may be included in the core in order to impart a good resilience. The organosulfur compound is not particularly limited, provided it can enhance the rebound of the golf ball. Exemplary organosulfur compounds include thiophenols, thionaphthols, halogenated thiophenols, and metal salts of these. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol, and any of the following having 2 to 4 sulfur atoms: diphenylpolysulfides, dibenzylpolysulfides, dibenzoylpolysulfides, dibenzothiazoylpolysulfides and dithiobenzoylpolysulfides. The use of the zinc salt of pentachlorothiophenol is especially preferred.

It is recommended that the amount of organosulfur compound included per 100 parts by weight of the base rubber be preferably 0 part by weight or more, more preferably at least 0.05 part by weight, and even more preferably at least 0.1 part by weight, and that the upper limit be preferably not more than 5 parts by weight, more preferably not more than 3 parts by weight, and even more preferably not more than 2.5 parts by weight. Including too much organosulfur compound may make a greater rebound-improving effect (particularly on shots with a W #1) unlikely to be obtained, may make the core too soft or may worsen the feel of the ball at impact. On the other hand, including too little may make a rebound-improving effect unlikely.

More specifically, decomposition of the organic peroxide within the core formulation can be promoted by the direct addition of water (or a water-containing material) to the core material. The decomposition efficiency of the organic peroxide within the core-forming rubber composition is known to change with temperature; starting at a given temperature, the decomposition efficiency rises with increasing temperature. If the temperature is too high, the amount of decomposed radicals rises excessively, leading to recombination between radicals and, ultimately, deactivation. As a result, fewer radicals act effectively in crosslinking. Here, when a heat of decomposition is generated by decomposition of the organic peroxide at the time of core vulcanization, the vicinity of the core surface remains at substantially the same temperature as the temperature of the vulcanization mold, but the temperature near the core center, due to the build-up of heat of decomposition by the organic peroxide which has decomposed from the outside, becomes considerably higher than the mold temperature. In cases where water (or a water-containing material) is added directly to the core, because the water acts to promote decomposition of the organic peroxide, radical reactions like those described above can be made to differ at the core center and core surface. That is, decomposition of the organic peroxide is further promoted near the center of the core, bringing about greater radical deactivation, which leads to a further decrease in the amount of active radicals. As a result, it is possible to obtain a core in which the crosslink densities at the core center and the core surface differ markedly. It is also possible to obtain a core having different dynamic viscoelastic properties at the core center.

The water included in the core material is not particularly limited, and may be distilled water or tap water. The use of distilled water that is free of impurities is especially preferred. The amount of water included per 100 parts by weight of the base rubber is preferably at least 0.1 part by weight, and more preferably at least 0.3 parts by weight. The upper limit is preferably not more than 5 parts by weight, and more preferably not more than 4 parts by weight.

The core can be produced by vulcanizing and curing the rubber composition containing the above ingredients. For example, the core can be produced by using a Banbury mixer, roll mill or other mixing apparatus to intensively mix the rubber composition, subsequently compression molding or injection molding the mixture in a core mold, and curing the resulting molded body by suitably heating it under conditions sufficient to allow the organic peroxide or co-crosslinking agent to act, such as at a temperature of between 100 and 200° C., preferably between 140 and 180° C., for 10 to 40 minutes.

Next, the hardness profile of the core is described. The core hardness described below refers to the Shore C hardness. This Shore C hardness is the hardness value measured with a Shore C durometer in general accordance with ASTM D2240. Although, for example, the timing of the read-off of measurements differs from that in the technique used for measuring JIS-C hardness, the measured Shore C hardness values do not differ much from and, in fact, are closely similar to the JIS-C values.

The hardness at the core center (Cc) is preferably at least 51, more preferably at least 53, and even more preferably at least 55. The upper limit is preferably not more than 67, more preferably not more than 66, and even more preferably not more than 65. When this value is too large, the spin rate may rise, resulting in a poor distance, or the feel at impact may become hard. On the other hand, when this value is too small, the durability to cracking on repeated impact may worsen, or the feel at impact may become softer than is undesirable.

The hardness at a position 2.5 mm from the core center (C2.5) is preferably at least 58, and more preferably at least 62. The upper limit is preferably not more than 70, and more preferably not more than 66. When this value is too small, the rebound may become low, decreasing the distance traveled by the ball, or the durability to cracking on repeated impact may worsen. On the other hand, when this value is too high, the feel at impact may become hard or the spin rate on full shots may rise, as a result of which the intended distance may not be achieved.

The hardness at a position 5 mm from the core center (C5) is preferably at least 60, and more preferably at least 64. The upper limit is preferably not more than 72, and more preferably not more than 68. A hardness outside of this range may lead to undesirable results similar to those described above for the hardness at the position 2.5 mm from the center of the core (C2.5).

The hardness at a position 7.5 mm from the core center (C7.5) is preferably at least 60, and more preferably at least 64. The upper limit is preferably not more than 72, and more preferably not more than 68. A hardness outside of this range may lead to undesirable results similar to those described above for the hardness at the position 2.5 mm from the center of the core (C2.5).

The hardness at a position 10 mm from the core center (C10) is preferably at least 60, and more preferably at least 64. The upper limit is preferably not more than 73, and more preferably not more than 69. A hardness outside of this range may lead to undesirable results similar to those described above for the hardness at the position 2.5 mm from the center of the core (C2.5).

The hardness at a position 12.5 mm from the core center (C12.5) is preferably at least 65, and more preferably at least 69. The upper limit is preferably not more than 76, and more preferably not more than 72. A hardness outside of this range may lead to undesirable results similar to those described above for the hardness at the position 2.5 mm from the center of the core (C2.5).

The hardness at a position 15 mm from the core center (C15) is preferably at least 72, and more preferably at least 76. The upper limit is preferably not more than 83, and more preferably not more than 79. A hardness outside of this range may lead to undesirable results similar to those described above for the hardness at the position 2.5 mm from the center of the core (C2.5).

The hardness at the core surface (Cs) is preferably at least 86, more preferably at least 88, and even more preferably at least 90. The upper limit is preferably not more than 98, more preferably not more than 97, and even more preferably not more than 96. Expressed in terms of the Shore D hardness, the surface hardness of the core is preferably at least 52, more preferably at least 54, and even more preferably at least 56. The upper limit is preferably not more than 64, more preferably not more than 62, and even more preferably not more than 60. When this value is too large, the feel at impact may be hard, or the durability to cracking on repeated impact may worsen. On the other hand, when this value is too small, the spin rate may rise excessively or the rebound may decrease, resulting in a poor flight performance.

It is critical for the difference between the core surface hardness (Cs) and the core center hardness (Cc), i.e., (Cs−Cc), to be at least 27, preferably at least 29, and more preferably at least 30. The upper limit is preferably not more than 35, more preferably not more than 34, and even more preferably not more than 33. When this value is too large, the initial velocity on full shots may decrease, as a result of which the intended distance may not be obtained, or the durability to cracking on repeated impact may worsen. On the other hand, when this value is too small, the spin rate on full shots may rise, as a result of which the intended distance may not be obtained.

The core hardness distribution in this invention is characterized in that, letting $C_M$ be the Shore C hardness at a midpoint M between the core center and surface, $C_{M+2.5}$, $C_{M+5.0}$ and $C_{M+7.5}$ be the Shore C hardnesses at, respectively, positions 2.5 mm, 5.0 mm and 7.5 mm from the midpoint M toward the core surface side, and $C_{M-2.5}$, $C_{M-5.0}$ and $C_{M-7.5}$ be the Shore C hardnesses at, respectively, positions 2.5 mm, 5.0 mm and 7.5 mm from the midpoint M toward the core center side, the surface areas A to F defined as follows $$\text{surface area } A\text{: } \tfrac{1}{2}\times 2.5\times(C_{M-5.0}-C_{M-7.5}),$$

$$\text{surface area } B\text{: } \tfrac{1}{2}\times 2.5\times(C_{M-2.5}-C_{M-5.0}),$$

$$\text{surface area } C\text{: } \tfrac{1}{2}\times 2.5\times(C_{M}-C_{M-2.5}),$$

$$\text{surface area } D\text{: } \tfrac{1}{2}\times 2.5\times(C_{M+2.5}-C_{M}),$$

$$\text{surface area } E\text{: } \tfrac{1}{2}\times 2.5\times(C_{M+5.0}-C_{M+2.5}),$$

$$\text{surface area } F\text{: } \tfrac{1}{2}\times 2.5\times(C_{M+7.5}-C_{M+5.0}),$$

satisfy the condition $$(\text{surface area } D+\text{surface area } E)-(\text{surface area } A+\text{surface area } B+\text{surface area } C)\geq 1,$$

and $$\text{surface area } C<\text{surface area } D<\text{surface area } E.$$

Figure 2:
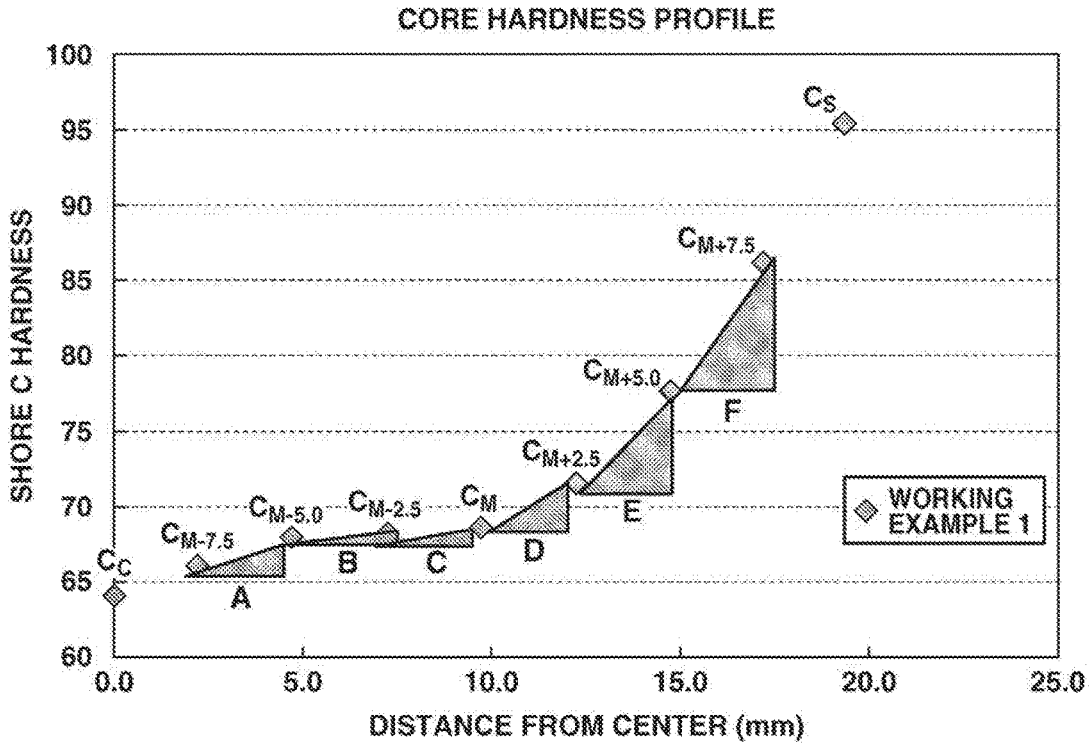
FIG. 2 is a graph that uses core hardness profile data from Working Example 1 to explain surface areas A to F in a core hardness profile.

FIG. 2 shows a graph that uses core hardness profile data from Working Example 1 to explain surface areas A to F. As is apparent from the graph, each of surface areas A to F is the surface area of a triangle whose base is the difference between specific distances and whose height is the difference in hardness between the positions at these specific distances.

The lower limit value of (surface area D+surface area E)−(surface area A+surface area B+surface area C) above is preferably at least 1, more preferably at least 5, and even more preferably at least 7. This value has no particular upper limit, although it is preferably not more than 14, more preferably not more than 12, and even more preferably not more than 10. When this value is too small, the spin rate-lowering effect on shots with a driver (W #1) may be inadequate and a good distance may not be achieved. On the other hand, when this value is too large, the initial velocity of the ball when struck may be low and a good distance may not be achieved, or the durability to cracking on repeated impact may worsen.

In the above core hardness distribution, the value of surface area D is larger than the value of surface area C, and the value of surface area E is larger than the value of surface area D. When the above relationship between the surface area D and the surface C is not satisfied, or when the above relationship between the surface area E and the surface D is not satisfied, the spin rate lowering effect on shots with a driver (W #1) may be inadequate, or the initial velocity of the ball when struck may become low, as a result of which a good distance may not be achieved. The difference of the value (surface area D−surface area C) is preferably at least 1.0, more preferably at least 2.0, and even more preferably at least 3.0. The difference of the value (surface area E−surface area D) is preferably at least 0.5, more preferably at least 1.2, and even more preferably at least 2.0.

It is also preferable that the value of surface area C is equal to or larger than the value of surface area B. Namely, it is preferable that the surface areas B to E in the core hardness profile satisfy the condition $$\text{surface area } B \leq \text{surface area } C < \text{surface area } D < \text{surface area } E.$$

The difference of the value (surface area C−surface area B) is preferably at least 0, more preferably at least 0.1, and even more preferably at least 0.2.

In the above core hardness distribution, the value of (surface area D+surface area E+surface area F)−(surface area A+surface area B+surface area C) above is preferably at least 10, more preferably at least 14, and even more preferably at least 16. The upper limit is preferably not more than 24, more preferably not more than 23, and even more preferably not more than 22. When this value is too small, the spin rate lowering effect on shots with a driver (W #1) may be inadequate, as a result of which a good distance may not be achieved. When this value is too large, the initial velocity of the ball when struck may become low, resulting in a poor distance, or the durability to cracking on repeated impact may worsen.

In the core hardness profile, it is preferable for the following condition to be satisfied: $0.40 \leq [(\text{surface area D}+\text{surface area E}+\text{surface area F})-(\text{surface area A}+\text{surface area B}+\text{surface area C})]/(Cs-Cc) \leq 0.85$. The lower limit value here is preferably at least 0.45, and more preferably at least 0.50. The upper limit value in this formula is preferably not more than 0.75, and more preferably not more than 0.65. When this value is too small, the spin rate-lowering effect on shots with a driver (W #1) may be inadequate, and so a good distance may not be achieved. On the other hand, when this value is too large, the initial velocity of the ball when struck may be low, resulting in a poor distance, or the durability to cracking on repeated impact may worsen.

Next, the intermediate layer is described.

The intermediate layer has a material hardness on the Shore D scale which, although not particularly limited, is preferably at least 60, more preferably at least 62, and even more preferably at least 64. The upper limit is preferably not more than 70, more preferably not more than 68, and even more preferably not more than 66. The surface hardness of the sphere obtained by encasing the core with the intermediate layer (intermediate layer-encased sphere), expressed on the Shore D scale, is preferably at least 66, more preferably at least 68, and even more preferably at least 70. The upper limit is preferably not more than 76, more preferably not more than 74, and even more preferably not more than 72. When the material and surface hardnesses of the intermediate layer are lower than the above respective ranges, the rebound on full shots may be inadequate or the spin rate on full shots may rise excessively, resulting in a poor distance. On the other hand, when the material and surface hardnesses are too high, the durability to cracking on repeated impact may worsen or the feel at impact may end up becoming too hard.

The intermediate layer has a thickness of preferably at least 0.8 mm, more preferably at least 1.0 mm, and even more preferably at least 1.1 mm. The upper limit in the intermediate layer thickness is preferably not more than 1.7 mm, more preferably not more than 1.5 mm, and even more preferably not more than 1.3 mm. It is preferable for the intermediate layer thickness to be greater than the thickness of the subsequently described cover. When the intermediate layer thickness falls outside of the above range in values, or the intermediate layer is formed so as to be thinner than the cover, the spin rate-lowering effect on shots with a driver (W #1) may be inadequate, as a result of which a good distance may not be achieved.

Various types of thermoplastic resins, particularly ionomer resins, that are used as golf ball materials may be suitably used as the intermediate layer material. Commercial products may be used as the ionomer resin. Alternatively, the intermediate layer-forming resin material that is used may be one obtained by blending, of commercially available ionomer resins, a high-acid ionomer resin having an acid content of at least 16 wt % into a conventional ionomer resin. The high rebound and spin rate-lowering effect obtained with such a blend makes it possible to achieve a good distance on shots with a driver (W #1).

The amount of unsaturated carboxylic acid included in the high-acid ionomer resin (acid content) is typically at least 16 wt %, preferably at least 17 wt %, and more preferably at least 18 wt %. The upper limit is preferably not more than 22 wt %, more preferably not more than 21 wt %, and even more preferably not more than 20 wt %. When this value is too small, the spin rate on full shots may rise, as a result of which the desired distance may not be achieved. On the other hand, when this value is too large, the feel at impact may be too hard, or the durability to cracking on repeated impact may worsen.

The amount of high-acid ionomer resin per 100 parts by weight of the resin material is preferably at least 10 wt %, more preferably at least 30 wt %, and even more preferably at least 60 wt %. The upper limit is generally up to 100 wt %, preferably 90 wt % or less, and more preferably 80 wt % or less. When the amount of such high-acid ionomer resin included is too low, the spin rate on shots with a driver (W #1) may be high, as a result of which a good distance may not be achieved. On the other hand, when the amount of high-acid ionomer resin included is too high, the durability to cracking on repeated impact may worsen.

Depending on the intended use, optional additives may be suitably included in the intermediate layer material. For example, pigments, dispersants, antioxidants, ultraviolet absorbers and light stabilizers may be added. When these additives are included, the amount added per 100 parts by weight of the base resin is preferably at least 0.1 part by weight, and more preferably at least 0.5 part by weight. The upper limit is preferably not more than 10 parts by weight, and more preferably not more than 4 parts by weight.

It is desirable to abrade the surface of the intermediate layer in order to increase adhesion of the intermediate layer material with the polyurethane that is preferably used in the subsequently described cover material. In addition, following such abrasion treatment, it is desirable to apply a primer (adhesive) to the surface of the intermediate layer or to add an adhesion reinforcing agent to the material.

The specific gravity of the intermediate layer material is typically less than 1.1, preferably between 0.90 and 1.05, and more preferably between 0.93 and 0.99. Outside of this range, the rebound of the overall ball may decrease and so a good distance may not be obtained, or the durability of the ball to cracking on repeated impact may worsen.

The sphere obtained by encasing the core with the intermediate layer (intermediate layer-encased sphere) has a deflection when compressed under a final load of 1,275 N (130 kgf) from an initial load of 98 N (10 kgf) which, although not particularly limited, is preferably at least 2.1 mm and preferably not more than 3.3 mm. When the deflection of this sphere is too large, that is, when the sphere is too soft, the feel at impact may be too soft, the durability to repeated impact may worsen, or the initial velocity on full shots may be low, as a result of which the intended distance may not be achieved. On the other hand, when the deflection of this sphere is too small, i.e., when the sphere is too hard, the feel at impact may be too hard, or the spin rate on full shots may rise, as a result of which the intended distance may not be achieved.

Next, the cover is described.

The cover has a material hardness on the Shore D scale which, although not particularly limited, is preferably at least 35, and more preferably at least 40. The upper limit is preferably not more than 55, more preferably not more than 53, and even more preferably not more than 50. The surface hardness of the sphere obtained by encasing the intermediate layer-encased sphere with the cover (i.e., the ball), expressed on the Shore D scale, is preferably at least 55, and more preferably at least 58. The upper limit is preferably not more than 66, more preferably not more than 64, and even more preferably not more than 62. When the material hardness of the cover and the ball surface hardness are too much lower than the above respective ranges, the spin rate of the ball on shots with a driver (W #1) may rise, as a result of which a good distance may not be achieved. On the other hand, when the material hardness of the cover and the ball surface hardness are too high, the ball controllability in the short game may worsen or the scuff resistance may worsen.

The cover has a thickness of preferably at least 0.3 mm, more preferably at least 0.45 mm, and even more preferably at least 0.6 mm. The upper limit in the cover thickness is preferably not more than 1.2 mm, more preferably not more than 1.0 mm, and even more preferably not more than 0.8 mm. When the cover is too thin, the ball may not be receptive to spin in the short game or the scuff resistance may worsen. When the cover is too thick, the spin rate of the ball on shots with a driver (W #1) may rise and the initial velocity may decrease, as a result of which a good distance may not be achieved.

Various types of thermoplastic resins employed as cover stock in golf balls may be used as the cover material. For reasons having to do with ball controllability and scuff resistance, preferred use can be made of a urethane resin. From the standpoint of the mass productivity of the manufactured balls in particular, it is preferable to use a thermoplastic resin that is composed primarily of a thermoplastic polyurethane, and especially preferable to use a resin composition in which the main components are (A) a thermoplastic urethane and (B) a polyisocyanate compound.

It is recommended that the total weight of components (A) and (B) combined be at least 60%, and preferably at least 70%, of the overall amount of the cover-forming resin composition. Components (A) and (B) are described below.

The thermoplastic polyurethane (A) has a structure which includes soft segments composed of a polymeric polyol (polymeric glycol) that is a long-chain polyol, and hard segments composed of a chain extender and a polyisocyanate compound. Here, the long-chain polyol serving as a starting material may be any that has hitherto been used in the art relating to thermoplastic polyurethanes, and is not particularly limited. Illustrative examples include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly, or two or more may be used in combination. Of these, in terms of being able to synthesize a thermoplastic polyurethane having a high rebound resilience and excellent low-temperature properties, a polyether polyol is preferred.

Any chain extender that has hitherto been employed in the art relating to thermoplastic polyurethanes may be suitably used as the chain extender. For example, low-molecular-weight compounds with a molecular weight of 400 or less which have on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these, the chain extender is preferably an aliphatic diol having 2 to 12 carbon atoms, and more preferably 1,4-butylene glycol.

Any polyisocyanate compound hitherto employed in the art relating to thermoplastic polyurethanes may be suitably used without particular limitation as the polyisocyanate compound (B). For example, use may be made of one or more selected from the group consisting of 4,4'-diphenylmethane diisocyanate, 2,4-toluene diisocyanate, 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbomene diisocyanate, trimethylhexamethylene diisocyanate and dimer acid diisocyanate. However, depending on the type of isocyanate, the crosslinking reactions during injection molding may be difficult to control. In the practice of the invention, to provide a balance between stability at the time of production and the properties that are manifested, it is most preferable to use the following aromatic diisocyanate: 4,4'-diphenylmethane diisocyanate.

Commercially available products may be used as the thermoplastic polyurethane serving as component (A). Illustrative examples include Pandex T-8295, Pandex T-8290 and Pandex T-8260 (all from DIC Bayer Polymer, Ltd.).

A thermoplastic elastomer other than the above thermoplastic polyurethanes may also be optionally included as a separate component, i.e., component (C), together with above components (A) and (B). By including this component (C) in the above resin blend, the flowability of the resin blend can be further improved and properties required of the golf ball cover material, such as resilience and scuff resistance, can be increased.

The compositional ratio of above components (A), (B) and (C) is not particularly limited. However, to fully and successfully elicit the advantageous effects of the invention, the compositional ratio (A):(B):(C) is preferably in the weight ratio range of from 100:2:50 to 100:50:0, and more preferably from 100:2:50 to 100:30:8.

In addition, various additives other than the components making up the above thermoplastic polyurethane may be optionally included in this resin blend. For example, pigments, dispersants, antioxidants, light stabilizers, ultraviolet absorbers and internal mold lubricants may be suitably included.

The sphere obtained by encasing the intermediate layer-encased sphere with the cover (i.e., the ball) has a deflection when compressed under a final load of 1,275 N (130 kgf) from an initial load of 98 N (10 kgf) which, although not particularly limited, is preferably at least 2.0 mm, more preferably at least 2.2 mm, and even more preferably at least 2.4 mm. The upper limit is preferably not more than 3.3 mm, more preferably not more than 3.1 mm, and even more preferably not more than 2.9 mm. When the ball deflection is too large, i.e., when the ball is too soft, the feel at impact may be too soft, the durability to repeated impact may worsen, or the initial velocity when hit on a full shot may be low, as a result of which the intended distance may not be achieved. On the other hand, when the ball deflection is too small, i.e., when the ball is too hard, the feel at impact may be too hard, or the spin rate on full shots may rise, as a result of which the intended distance may not be achieved.

The manufacture of multi-piece solid golf balls in which the above-described core, intermediate layer and cover (outermost layer) are formed as successive layers may be carried out by a customary method such as a known injection molding process. For example, a multi-piece golf ball can be produced by injection-molding the intermediate layer material over the core so as to obtain an intermediate layer-encased sphere, and then injection-molding the cover material over the intermediate layer-encased sphere. Alternatively, the encasing layers may each be formed by enclosing the sphere to be encased within two half-cups that have been pre-molded into hemispherical shapes and then molding under applied heat and pressure.

In this invention, it is critical for the surface hardness of the intermediate layer-encased sphere to be higher than the surface hardness of the ball. When this hardness relationship is not satisfied, it may not be possible to achieve both a good flight performance on full shots and good controllability in the short game using a wedge. The difference between the surface hardness of the intermediate layer-encased sphere and the surface hardness of the ball, expressed in terms of Shore D hardness, is preferably from 1 to 20, more preferably from 5 to 16, and even more preferably from 8 to 13. When this difference is small, the spin rate-lowering effect on full shots may be inadequate, as a result of which a good distance may not be achieved. On the other hand, when this difference is too large, the durability to cracking on repeated impact may worsen.

Letting P and Q be the deflections (mm) of the core and the ball, respectively, when each of these spheres is compressed under a final load of 1,275 N (130 kgf) from an initial load of 98 N (10 kgf), the value P-Q is preferably from 0.5 to 1.3 mm, more preferably from 0.6 to 1.1 mm, and even more preferably form 0.7 to 0.9 mm. When this value is too small, the spin rate on full shots may rise excessively, as a result of which the intended distance on shots with a driver (W #1) may not be obtained. When this value is too large, the initial velocity of the ball when hit on full shots may become too low, as a result of which the intended distance may not be achieved on shots with a driver (W #1).

Numerous dimples may be formed on the outside surface of the cover serving as the outermost layer. The number of dimples arranged on the cover surface, although not particularly limited, is preferably at least 250, more preferably at least 300, and even more preferably at least 320. The upper limit is preferably not more than 380, more preferably not more than 350, and even more preferably not more than 340. When the number of dimples is higher than this range, the ball trajectory may become lower, as a result of which the distance traveled by the ball may decrease. On the other hand, when the number of dimples is lower that this range, the ball trajectory may become higher, as a result of which a good distance may not be achieved.

The dimple shapes used may be of one type or may be a combination of two or more types suitably selected from among, for example, circular shapes, various polygonal shapes, dewdrop shapes and oval shapes. When circular dimples are used, the dimple diameter may be set to at least about 2.5 mm and up to about 6.5 mm, and the dimple depth may be set to at least 0.08 mm and up to 0.30 mm.

In order for the aerodynamic properties to be fully manifested, it is desirable for the dimple coverage ratio on the spherical surface of the golf ball, i.e., the dimple surface coverage SR, which is the sum of the individual dimple surface areas, each defined by the flat plane circumscribed by the edge of a dimple, as a percentage of the spherical surface area of the ball were the ball to have no dimples thereon, to be set to at least 70% and not more than 90%. Also, to optimize the ball trajectory, it is desirable for the value $V_o$, defined as the spatial volume of the individual dimples below the flat plane circumscribed by the dimple edge, divided by the volume of the cylinder whose base is the flat plane and whose height is the maximum depth of the dimple from the base, to be set to at least 0.35 and not more than 0.80. Moreover, it is preferable for the ratio VR of the sum of the volumes of the individual dimples, each formed below the flat plane circumscribed by the edge of a dimple, with respect to the volume of the ball sphere were the ball surface to have no dimples thereon, to be set to at least 0.6% and not more than 1.0%. Outside of the above ranges in these respective values, the resulting trajectory may not enable a good distance to be obtained and so the ball may fail to travel a fully satisfactory distance.

In addition, by optimizing the cross-sectional shape of the dimples, the variability in the flight of the ball can be reduced and the aerodynamic performance improved. Moreover, by holding the percentage change in depth at given positions in the dimples within a fixed range, the dimple effect can be stabilized and the aerodynamic performance improved. The ball has arranged thereon at least one dimple with the cross-sectional shape shown below. This is exemplified by dimples having distinctive cross-sectional shapes like that shown in FIG. 3A. FIG. 3A is an enlarged cross-sectional view of a dimple that is circular as seen from above. In this diagram, the symbol D represents a dimple, E represents an edge of the dimple, P represents a deepest point of the dimple, the straight line L is a reference line which passes through the dimple edge E and a center O of the dimple, and the dashed line represents an imaginary spherical surface. The foot of a perpendicular drawn from the deepest point P of the dimple D to an imaginary plane defined by the peripheral edge of the dimple D coincides with the dimple center O. The dimple edge E serves as the boundary between the dimple D and regions (lands) on the ball surface where dimples D are not formed, and corresponds to points where the imaginary spherical surface is tangent to the ball surface (the same applies below). The dimples D shown in FIG. 3 are circular dimples as seen from above; i.e., in a plan view. The center O of the dimple in each plan view coincides with the deepest point P.

The cross-sectional shape of the dimple D must satisfy the following conditions.

First, as condition (i), let the foot of a perpendicular drawn from a deepest point P of the dimple to an imaginary plane defined by a peripheral edge of the dimple be the dimple center O, and let a straight line that passes through the dimple center O and any one point on the edge E of the dimple be the reference line L.

Next, as condition (ii), divide a segment of the reference line L from the dimple edge E to the dimple center O into at least 100 points. Then compute the distance ratio for each point when the distance from the dimple edge E to the dimple center O is set to 100%. The dimple edge E is the origin, which is the 0% position on the reference line L, and the dimple center O is the 100% position with respect to segment EO on the reference line L.

Next, as condition (iii), compute the dimple depth ratio at every 20% from 0 to 100% of the distance from the dimple edge E to the dimple center O. In this case, the dimple center O is at the deepest part P of the dimple and has a depth H (mm). Letting this be 100% of the depth, the dimple depth ratio at each distance is determined. The dimple depth ratio at the dimple edge E is 0%.

Next, as condition (iv), at the depth ratios in dimple regions 20 to 100% of the distance from the dimple edge E to the dimple center O, determine the change in depth ΔH every 20% of the distance and design a dimple cross-sectional shape such that the change ΔH is at least 6% and not more than 24% in all regions corresponding to from 20 to 100% of the distance.

In this invention, by quantifying the cross-sectional shape of the dimple in this way, that is, by setting the change in dimple depth ΔH to at least 6% and not more than 24%, and thereby optimizing the dimple cross-sectional shape, the flight variability decreases, enhancing the aerodynamic performance of the ball. This change ΔH is preferably from 8 to 22%, and more preferably from 10 to 20%.

Also, to further increase the advantageous effects of the invention, in dimples having the above specific cross-sectional shape, it is preferable for the change in dimple depth ΔH to reach a maximum at 20% of the distance from the dimple edge E to the dimple center O. Moreover, it is preferable for two or more points of inflection to be included on the curved line describing the cross-sectional shape of the dimple having the above specific cross-sectional shape.

A paint film layer (coating layer) may be formed on the surface of the cover. This paint film layer can be formed by applying various types of paint. Because the paint film layer must be capable of enduring the harsh conditions of golf ball use, it is desirable to use as the paint a composition in which the chief component is a urethane paint composed of a polyol and a polyisocyanate.

The polyol component is exemplified by acrylic polyols and polyester polyols. These polyols include modified polyols. To further increase workability, other polyols may also be added.

It is suitable to use two types of polyester polyols together as the polyol component. In this case, letting the two types of polyester polyol be component (a) and component (b), a polyester polyol in which a cyclic structure has been introduced onto the resin skeleton may be used as the polyester polyol of component (a). Examples include polyester polyols obtained by the polycondensation of a polyol having an alicyclic structure, such as cyclohexane dimethanol, with a polybasic acid; and polyester polyols obtained by the polycondensation of a polyol having an alicyclic structure with a diol or triol and a polybasic acid. A polyester polyol having a branched structure may be used as the polyester polyol of component (b). Examples include polyester polyols having a branched structure, such as NIPPOLAN 800, from Tosoh Corporation.

The polyisocyanate is exemplified without particular limitation by commonly used aromatic, aliphatic, alicyclic and other polyisocyanates. Specific examples include tolylene diisocyanate, diphenylmethane diisocyanate, xylylene diisocyanate, tetramethylene diisocyanate, hexamethylene diisocyanate, lysine diisocyanate, isophorone diisocyanate, 1,4-cyclohexylene diisocyanate, naphthalene diisocyanate, trimethylhexamethylene diisocyanate, dicyclohexylmethane diisocyanate and 1-isocyanato-3,3,5-trimethyl-4-isocyanatomethylcyclohexane. These may be used singly or in admixture.

Depending on the painting conditions, various types of organic solvents may be mixed into the paint composition. Examples of such organic solvents include aromatic solvents such as toluene, xylene and ethylbenzene; ester solvents such as ethyl acetate, butyl acetate, propylene glycol methyl ether acetate and propylene glycol methyl ether propionate; ketone solvents such as acetone, methyl ethyl ketone, methyl isobutyl ketone and cyclohexanone; ether solvents such as diethylene glycol dimethyl ether, diethylene glycol diethyl ether and dipropylene glycol dimethyl ether; alicyclic hydrocarbon solvents such as cyclohexane, methyl cyclohexane and ethyl cyclohexane; and petroleum hydrocarbon solvents such as mineral spirits.

The thickness of the paint film layer made of the paint composition, although not particularly limited, is typically from 5 to 40 μm, and preferably from 10 to 20 μm. As used herein, "paint film layer thickness" refers to the paint film thickness obtained by averaging the measurements taken at a total of three places: the center of a dimple and two places located at positions between the dimple center and the dimple edge.

In this invention, the paint film layer composed of the paint composition has an elastic work recovery that is preferably at least 60%, and more preferably at least 80%. At a paint film layer elastic work recovery in this range, the paint film layer has a high elasticity and so the self-repairing ability is high, resulting in an outstanding abrasion resistance. Moreover, the performance attributes of golf balls coated with this paint composition can be improved. The method of measuring the elastic work recovery is described below.

The elastic work recovery is one parameter of the nanoindentation method for evaluating the physical properties of paint film layers, which is a nanohardness test method that controls the indentation load on a micro-newton (ptN) order and tracks the indenter depth during indentation to a nanometer (nm) precision. In prior methods, only the size of the dent (plastic deformation) corresponding to the maximum load could be measured. However, in the nanoindentation method, the relationship between the indentation load and the indentation depth can be obtained by automated and continuous measurement. Unlike in the past, there are no individual differences between observers when visually measuring deformation under an optical microscope, and so the physical properties of the paint film layer can be evaluated to a high precision. Given that the paint film layer on the ball surface is strongly affected by the impact of drivers and various other clubs and thus has a not inconsiderable influence on the golf ball properties, measuring the paint film layer by the nanohardness test method and carrying out such measurement to a higher precision than in the past is a very effective method of evaluation.

The hardness of the paint film layer, expressed on the Shore M hardness scale, is preferably at least 40, and more preferably at least 60. The upper limit is preferably not more than 95, and more preferably not more than 85. This Shore M hardness is obtained in general accordance with ASTM D2240. The hardness of the paint film layer, expressed on the Shore C hardness scale, is preferably at least 30 and has an upper limit of preferably not more than 90. This Shore C hardness is obtained in general accordance with ASTM D2240. At a paint film layer hardness that is higher than the above range, the paint film may become brittle when the ball is repeatedly struck, which may make it incapable of protecting the cover layer. On the other hand, a paint film layer hardness that is lower than the above range is undesirable because the ball readily incurs damage when striking hard objects.

In order for the ball to be endowed with both a good flight and a good spin performance on approach shots, letting Hc be the Shore C hardness of the paint film layer, the difference between the Shore C hardness $C_M$ at the midpoint M between the core center and surface and Hc ($C_M$–Hc) is preferably 0 or more, and more preferably at least 1. The upper limit is preferably not more than 20, and more preferably not more than 10.

When the above paint composition is used, the formation of a paint film layer on the surface of golf balls manufactured by a commonly known method can be carried out via the steps of preparing the paint composition at the time of application, applying the composition to the golf ball surface by a conventional painting operation, and drying the applied composition. The painting method is not particularly limited. For example, suitable use can be made of spray painting, electrostatic painting or dipping.

The multi-piece solid golf ball of the invention can be made to conform to the Rules of Golf for play. The inventive ball may be formed to a diameter which is such that the ball does not pass through a ring having an inner diameter of 42.672 mm and is not more than 42.80 mm, and to a weight which is preferably between 45.0 and 45.93 g.

EXAMPLES

The following Examples and Comparative Examples are provided to illustrate the invention, and are not intended to limit the scope thereof.

Examples 1 to 4, Comparative Examples 1 to 7

Formation of Core

Solid cores were produced by preparing rubber compositions for the respective Working Examples and Comparative Examples shown in Table 1, and then molding and vulcanizing the compositions under vulcanization conditions of 155° C. and 15 minutes.

TABLE 1

| Core formulation | Working Example | | | | Comparative Example | | | | | | |
|---|---|---|---|---|---|---|---|---|---|---|---|
| (pbw) | 1 | 2 | 3 | 4 | 1 | 2 | 3 | 4 | 5 | 6 | 7 |
| Polybutadiene A | 80 | 80 | 80 | 80 | 100 | 80 | 80 | 80 | 80 | 80 | 80 |
| Polybutadiene B | 20 | 20 | 20 | 20 | | 20 | 20 | 20 | 20 | 20 | 20 |
| Zinc acrylate | 43 | 37.2 | 43 | 43 | 28 | 27 | 37.75 | 35.5 | 43 | 44 | 31 |
| Organic peroxide (1) | 1.0 | 1.0 | 1.0 | 1.0 | 0.6 | 0.6 | 1.0 | 1.0 | 1.0 | 0.6 | 1.0 |
| Organic peroxide (2) | | | | | 1.2 | 0.6 | | | | | |
| Water | 1.2 | 1.2 | 1.2 | 1.2 | | | 0.6 | 0.6 | 1.0 | 0.8 | 0.8 |
| Antioxidant | 0.1 | 0.1 | 0.1 | 0.1 | 0.1 | 0.1 | 0.1 | 0.1 | | 0.1 | 0.1 |
| Barium sulfate (1) | 9.3 | 11.9 | 9.3 | 9.3 | 17.5 | 18.5 | | | | | |
| Barium sulfate (2) | | | | | | | | | 9.8 | 8.8 | 17.5 |
| Zinc oxide | 4.0 | 4.0 | 4.0 | 4.0 | 4.0 | 4.0 | 15.2 | 16.1 | 4.0 | 4.0 | 4.0 |
| Zinc stearate | | | | | 1.0 | 1.0 | | | | | |
| Zinc salt of pentachlorothiophenol | 0.3 | 0.3 | 0.3 | 0.3 | 0.2 | 0.2 | 0.3 | 0.5 | 0.3 | 0.3 | 0.6 |

Details on the ingredients mentioned in Table 1 are given below.

Polybutadiene A: Available under the trade name "BR 01" from JSR Corporation

Polybutadiene B: Available under the trade name "BR 51" from JSR Corporation

Zinc acrylate: "ZN-DA85S" from Nippon Shokubai Co., Ltd.

Organic Peroxide (1): Dicumyl peroxide, available under the trade name "Percumyl D" from NOF Corporation Organic Peroxide (2): A mixture of 1,1-di(t-butylperoxy) cyclohexane and silica, available under the trade name "Perhexa C-40" from NOF Corporation Water: Pure water (from Seiki Chemical Industrial Co., Ltd.)

Antioxidant: 2,2'-Methylenebis(4-methyl-6-butylphenol), available under the trade name "Nocrac NS-6" from Ouchi Shinko Chemical Industry Co., Ltd.

Barium sulfate (1): Baryte powder available as "Barico #100" from Hakusui Tech

Barium sulfate (2): Precipitated Barium Sulfate #100 from Sakai Chemical Co., Ltd.

Zinc oxide: Available under the trade name "Zinc Oxide Grade 3" from Sakai Chemical Co., Ltd.

Zinc stearate: Available under the trade name "Zinc Stearate G" from NOF Corporation Zinc salt of pentachlorothiophenol: Available from Wako Pure Chemical Industries, Ltd.

Formation of Intermediate Layer and Cover (Outermost Layer)

Next, an intermediate layer was formed by injection molding the intermediate layer material formulated as shown in Table 2 over the core, thereby giving an intermediate layer-encased sphere. Next, a cover (outermost layer) was formed by injection molding the cover material formulated as shown in Table 2 over the intermediate layer-encased sphere thus obtained. A plurality of given dimples common to all the Working Examples and Comparative Examples were formed at this time on the surface of the cover.

TABLE 2

| Resin composition (pbw) | No. 1 | No. 2 | No. 3 |
|---|---|---|---|
| AM7318 | | | 70 |
| AM7329 | | | 15 |

TABLE 2-continued

| Resin composition (pbw) | No. 1 | No. 2 | No. 3 |
|---|---|---|---|
| Himilan 1706 | | 35 | 15 |
| Himilan 1557 | | 15 | |
| Himilan 1605 | | 50 | |
| T-8290 | 75 | | |
| T-8283 | 25 | | |
| Hytrel 4001 | 11 | | |
| Silicone wax | 0.6 | | |
| Polyethylene wax | 1.2 | | |
| Isocyanate compound | 7.5 | | |
| Titanium oxide | 3.9 | | |
| Trimethylolpropane (TMP) | | 1.1 | 1.1 |

Trade names of the chief materials in the above table are given below.

Himilan, AM7318, AM7329: Ionomers available from DuPont-Mitsui Polychemicals Co., Ltd.

T-8290, T-8283: MDI-PTMG type thermoplastic polyurethanes available under the trade name "Pandex" from DIC Bayer Polymer, Ltd.

Hytrel: A polyester elastomer available from DuPont-Toray Co., Ltd.

Polyethylene wax: Available under the trade name "Sanwax 161P" from Sanyo Chemical Industries, Ltd.

Isocyanate compound: 4,4-Diphenylmethane diisocyanate

Dimples

Two families of dimples were used on the ball surface: A and B. Family A includes four types of dimples, details of which are shown in Table 3. The cross-sectional shape of these dimples is shown in FIG. 3A. Family B dimples include four types of dimples, details of which are shown in Table 4. The cross-sectional shape of the latter dimples is shown in FIG. 3B.

In the cross-sectional shapes in FIG. 3, the depth of each dimple from the reference line L to the inside wall of the dimple was determined at 100 equally spaced points on the reference line L from the dimple edge E to the dimple center O. The results are presented in Tables 3 and 4.

Next, the change in depth ΔH every 20% of the distance along the reference line L from the dimple edge E was determined. These values as well are presented in Tables 3 and 4.

TABLE 3

| Family A | | | | | |
|---|---|---|---|---|---|
| Dimple type | | No. 1 | No. 2 | No. 3 | No. 4 |
| Number of dimples | | 240 | 72 | 12 | 14 |
| Diameter (mm) | | 4.3 | 3.8 | 2.8 | 4.0 |
| Depth at point of maximum depth (mm) | | 0.15 | 0.16 | 0.17 | 0.16 |
| Dimple depths at each point (mm) | 20% | 0.06 | 0.07 | 0.07 | 0.07 |
| | 40% | 0.08 | 0.09 | 0.09 | 0.09 |
| | 60% | 0.11 | 0.11 | 0.12 | 0.11 |
| | 80% | 0.13 | 0.14 | 0.15 | 0.14 |
| | 100% | 0.15 | 0.16 | 0.17 | 0.16 |
| Percent change in dimple depth | 0%-20% | 41 | 41 | 41 | 41 |
| | 20%-40% | 15 | 15 | 15 | 15 |
| | 40%-60% | 15 | 15 | 15 | 15 |
| | 60%-80% | 19 | 19 | 19 | 19 |
| | 80%-100% | 10 | 10 | 10 | 10 |
| SR (%) | | 80 | | | |
| VR (%) | | 0.9 | | | |
| Percent of dimples having specified shape (%) | | 100 | | | |

TABLE 4

| Family B | | | | | |
|---|---|---|---|---|---|
| Dimple type | | No. 1 | No. 2 | No. 3 | No. 4 |
| Number of dimples | | 240 | 72 | 12 | 14 |
| Diameter (mm) | | 4.3 | 3.8 | 2.8 | 4.0 |
| Depth at point of maximum depth (mm) | | 0.14 | 0.15 | 0.15 | 0.16 |
| Dimple depths at each point (mm) | 20% | 0.05 | 0.05 | 0.06 | 0.06 |
| | 40% | 0.09 | 0.10 | 0.10 | 0.11 |
| | 60% | 0.12 | 0.13 | 0.13 | 0.13 |
| | 80% | 0.14 | 0.14 | 0.14 | 0.15 |
| | 100% | 0.14 | 0.15 | 0.15 | 0.16 |
| Percent change in dimple depth | 0%-20% | 35 | 37 | 37 | 38 |
| | 20%-40% | 30 | 33 | 31 | 29 |
| | 40%-60% | 21 | 17 | 18 | 17 |
| | 60%-80% | 11 | 10 | 10 | 11 |
| | 80%-100% | 4 | 4 | 3 | 5 |
| SR (%) | | 79 | | | |
| VR (%) | | 0.9 | | | |
| Percent of dimples having specified shape (%) | | 0 | | | |

Formation of Paint Film Layer (Coating Layer)

Next, as a paint composition common to all of the Working Examples and Comparative Examples, paint composition I shown in Table 5 below was applied with an air spray gun onto the surface of the cover (outermost layer) on which numerous dimples had been formed, thereby producing golf balls having a 15 μm-thick paint film layer formed thereon.

TABLE 5

| | | | |
|---|---|---|---|
| Paint formulation I (pbw) | Base resin | Polyester polyol (A) | 23 |
| | | Polyester polyol (B) | 15 |
| | | Organic solvent | 62 |
| | Curing agent | Isocyanate (HMDI isocyanurate) | 42 |
| | | Solvent | 58 |
| | Molar blending ratio (NCO/OH) | | 0.89 |
| Paint film properties | Elastic work recovery (%) | | 84 |
| | Shore M hardness | | 84 |
| | Shore C hardness | | 63 |
| | Thickness (μm) | | 15 |

Polyester Polyol (A) Synthesis Example

A reactor equipped with a reflux condenser, a dropping funnel, a gas inlet and a thermometer was charged with 140 parts by weight of trimethylolpropane, 95 parts by weight of ethylene glycol, 157 parts by weight of adipic acid and 58 parts by weight of 1,4-cyclohexanedimethanol, following which the temperature was raised to between 200 and 240° C. under stirring and the reaction was effected by 5 hours of heating. This yielded Polyester Polyol (A) having an acid value of 4, a hydroxyl value of 170 and a weight-average molecular weight (Mw) of 28,000.

Next, the Polyester Polyol (A) synthesized above was dissolved in butyl acetate, thereby preparing a varnish having a nonvolatiles content of 70 wt %.

The base resin for Paint Composition I in Table 5 was prepared by mixing 23 parts by weight of the above polyester polyol solution together with 15 parts by weight of Polyester Polyol (B) (the saturated aliphatic polyester polyol NIPPOLAN 800 from Tosoh Corporation; weight-average molecular weight (Mw), 1,000; 100% solids) and the organic solvent. This mixture had a nonvolatiles content of 38.0 wt %.

Elastic Work Recovery

The elastic work recovery of the paint was measured using a paint film sheet having a thickness of 50 μm. The ENT-2100 nanohardness tester from Erionix Inc. was used as the measurement apparatus, and the measurement conditions were as follows.

Indenter: Berkovich indenter (material: diamond; angle α: 65.030)

Load F: 0.2 mN

Loading time: 10 seconds

Holding time: 1 second

Unloading time: 10 seconds

The elastic work recovery was calculated as follows, based on the indentation work $W_{elast}$ (Nm) due to spring-back deformation of the coating and on the mechanical indentation work $W_{total}$ (Nm).

$$\text{Elastic work recovery}=W_{elast}/W_{total}\times 100(\%)$$

Various properties of the resulting golf balls, including the internal hardnesses of the core at various positions, the diameters of the core and the respective layer-encased spheres, the thickness and material hardness of each layer, and the surface hardness and deformation (deflection) under specific loading of the respective layer-encased spheres were evaluated by the following methods. The results are presented in Table 6.

Diameters of Cores and Intermediate Layer-Encased Spheres

The diameters at five random places on the surface were measured at a temperature of 23.9±1° C. and, using the average of these measurements as the measured value for a single core or intermediate layer-encased sphere, the average diameters for ten test specimens were determined.

Ball Diameter

The diameters at 15 random dimple-free areas on the surface of a ball were measured at a temperature of 23.9±1° C. and, using the average of these measurements as the measured value for a single ball, the average diameter for ten measured balls was determined.

Deflections of Core, Intermediate Layer-Encased Sphere and Ball

A core, intermediate layer-encased sphere or ball was placed on a hard plate and the amount of deflection when compressed under a final load of 1,275 N (130 kgf) from an initial load of 98 N (10 kgf) was measured. The amount of deflection here refers in each case to the measured value obtained after holding the test specimen isothermally at 23.9° C.

Core Hardness Profile

The indenter of a durometer was set substantially perpendicular to the spherical surface of the core, and the surface hardness of the core on the Shore C hardness scale was measured in accordance with ASTM D2240. Cross-sectional hardnesses at the center of the core and at given positions in each core were measured by perpendicularly pressing the indenter of a durometer against the region to be measured in the flat cross-sectional plane obtained by cutting the core into hemispheres. The measurement results are indicated as Shore C hardness values.

In addition, letting Cc be the Shore C hardness at the core center, Cs be the Shore C hardness at the core surface, $C_M$ be the Shore C hardness at a midpoint M between the core center and surface, $C_{M+2.5}$, $C_{M+5.0}$ and $C_{M+7.5}$ be the Shore C hardnesses at, respectively, positions 2.5 mm, 5.0 mm and 7.5 mm from the midpoint M toward the core surface side, and $C_{M-2.5}$, $C_{M-5.0}$ and $C_{M-7.5}$ be the Shore C hardnesses at, respectively, positions 2.5 mm, 5.0 mm and 7.5 mm from the midpoint M toward the core center side, the surface areas A to F defined as follows $$\text{surface area } A\text{: } \tfrac{1}{2}\times 2.5\times(C_{M-5.0}-C_{M-7.5}),$$

$$\text{surface area } B\text{: } \tfrac{1}{2}\times 2.5\times(C_{M-2.5}-C_{M-5.0}),$$

$$\text{surface area } C\text{: } \tfrac{1}{2}\times 2.5\times(C_{M}-C_{M-2.5}),$$

$$\text{surface area } D\text{: } \tfrac{1}{2}\times 2.5\times(C_{M+2.5}-C_{M}),$$

$$\text{surface area } E\text{: } \tfrac{1}{2}\times 2.5\times(C_{M+5.0}-C_{M+2.5}),\text{ and}$$

$$\text{surface area } F\text{: } \tfrac{1}{2}\times 2.5\times(C_{M+7.5}-C_{M+5.0})$$

were calculated, and the values of the following three expressions were determined:

(surface area *D*+surface area *E*+surface area *F*)−(surface area *A*+surface area *B*+surface area *C*)

(surface area *D*+surface area *E*)−(surface area *A*+surface area *B*+surface area *C*)

[(surface area *D*+surface area *E*+surface area *F*)−(surface area *A*+surface area *B*+surface area *C*)]/(*Cs*−*Cc*)

Surface areas A to F in the core hardness distribution are explained in FIG. 2, which is a graph that illustrates surface areas A to F using the core hardness profile data from Working Example 1.

Material Hardnesses (Shore D Hardnesses) of Intermediate Layer and Cover

The resin materials for each of these layers were molded into sheets having a thickness of 2 mm and left to stand for at least two weeks, following which the Shore D hardnesses were measured in accordance with ASTM D2240.

Surface Hardnesses (Shore D Hardnesses) of Intermediate Layer-Encased Sphere and Ball Measurements were taken by pressing the durometer indenter perpendicularly against the surface of the each sphere. The surface hardness of the ball (cover) is the measured value obtained at dimple-free places (lands) on the ball surface. The Shore D hardnesses were measured with a type D durometer in accordance with ASTM D2240.

TABLE 6

| | | Working Example | | | | Comparative Example | |
|---|---|---|---|---|---|---|---|
| | | 1 | 2 | 3 | 4 | 1 | 2 |
| Construction | | 3-piece | 3-piece | 3-piece | 3-piece | 3-piece | 3-piece |
| Core | Diameter (mm) | 38.64 | 38.63 | 38.64 | 38.64 | 38.64 | 38.63 |
| | Weight (g) | 34.97 | 35.01 | 34.97 | 34.97 | 34.97 | 35.01 |
| | Specific gravity (g/mm³) | 1.157 | 1.16 | 1.157 | 1.157 | 1.158 | 1.16 |
| | Deflection (P) (mm) | 3.2 | 3.7 | 3.2 | 3.2 | 3.1 | 3.8 |
| Core hardness profile | Surface hardness (Cs) | 95.4 | 90.2 | 95.4 | 95.4 | 84.5 | 78 |
| | Hardness 15 mm from center (C15) | 78.4 | 76.3 | 78.4 | 78.4 | 79.6 | 72.6 |
| | Hardness 12.5 mm from center (C12.5) | 71.9 | 69.7 | 71.9 | 71.9 | 75.0 | 71.7 |
| | Hardness 10 mm from center (C10) | 68.6 | 64.7 | 68.6 | 68.6 | 71.9 | 69.5 |
| | Hardness 7.5 mm from center (C7.5) | 68.2 | 64.0 | 68.2 | 68.2 | 71.1 | 67.6 |

TABLE 6-continued

| | | | | | | | |
|---|---|---|---|---|---|---|---|
| | Hardness 5 mm from center (C5) | 68.2 | 63.9 | 68.2 | 68.2 | 69.6 | 66.2 |
| | Hardness 2.5 mm from center (C2.5) | 66.3 | 61.8 | 66.3 | 66.3 | 67.4 | 64.6 |
| | Center hardness (Cc) | 63.9 | 57.8 | 63.9 | 63.9 | 64.7 | 62.1 |
| | Hardness 7.5 mm toward core surface side from midpoint M ($C_{M+7.5}$) | 86.1 | 82.5 | 86.1 | 86.1 | 82.1 | 75.3 |
| | Hardness 5 mm toward core surface side from midpoint M ($C_{M+5}$) | 77.5 | 75.4 | 77.5 | 77.5 | 79.0 | 72.4 |
| | Hardness 2.5 mm toward core surface side from midpoint M ($C_{M+2.5}$) | 71.5 | 69 | 71.5 | 71.5 | 74.5 | 71.4 |
| | Hardness at midpoint M ($C_M$) | 68.5 | 64.6 | 68.5 | 68.5 | 71.8 | 69.3 |
| | Hardness 2.5 mm toward core center side from midpoint M ($C_{M-2.5}$) | 68.2 | 64 | 68.2 | 68.2 | 70.9 | 67.4 |
| | Hardness 5 mm toward core center side from midpoint M ($C_{M-5}$) | 67.9 | 63.6 | 67.9 | 67.9 | 69.3 | 65.9 |
| | Hardness 7.5 mm toward core center side from midpoint M ($C_{M-7.5}$) | 66.0 | 61.3 | 66.0 | 66.0 | 67.0 | 64.3 |
| | Surface hardness − Center hardness (Cs − Cc) | 31.5 | 32.4 | 31.5 | 31.5 | 19.8 | 15.9 |
| | Surface area A: 1/2 × 2.5 × ($C_{M-5}$ − $C_{M-7.5}$) | 2.4 | 2.9 | 2.4 | 2.4 | 2.9 | 2.1 |
| | Surface area B: 1/2 × 2.5 × ($C_{M-2.5}$ − $C_{M-5}$) | 0.4 | 0.5 | 0.4 | 0.4 | 2.0 | 1.8 |
| | Surface area C: 1/2 × 2.5 × ($C_M$ − $C_{M-2.5}$) | 0.4 | 0.8 | 0.4 | 0.4 | 1.1 | 2.4 |
| | Surface area D: 1/2 × 2.5 × ($C_{M+2.5}$ − $C_M$) | 3.7 | 5.5 | 3.7 | 3.7 | 3.5 | 2.6 |
| | Surface area E: 1/2 × 2.5 × ($C_{M+5}$ − $C_{M+2.5}$) | 7.5 | 7.9 | 7.5 | 7.5 | 5.5 | 1.4 |
| | Surface area F: 1/2 × 2.5 × ($C_{M+7.5}$ − $C_{M+5}$) | 10.8 | 8.9 | 10.8 | 10.8 | 3.9 | 3.5 |
| | Surface areas A + B + C | 3.2 | 4.2 | 3.2 | 3.2 | 5.9 | 6.3 |
| | Surface areas D + E | 11.2 | 13.4 | 11.2 | 11.2 | 9.0 | 4.0 |
| | Surface areas D + E + F | 22.0 | 22.3 | 22.0 | 22.0 | 12.9 | 7.5 |
| | (Surface areas D + E + F) − (Surface areas A + B + C) | 18.8 | 18.1 | 18.8 | 18.8 | 7.0 | 1.2 |
| | (Surface areas D + E) − (Surface areas A + B + C) | 8.0 | 9.2 | 8.0 | 8.0 | 3.1 | −2.3 |
| | [(Surface areas D + E + F) − (Surface areas A + B + C)]/(Cs − Cc) | 0.60 | 0.56 | 0.60 | 0.60 | 0.35 | 0.08 |
| | Surface areas D − C | 3.3 | 4.7 | 3.3 | 3.3 | 2.4 | 0.2 |
| | Surface areas E − D | 3.8 | 2.4 | 3.8 | 3.8 | 2.1 | −1.2 |
| | Surface areas C − B | 0.0 | 0.3 | 0.0 | 0.0 | −0.9 | 0.6 |
| | Surface hardness (Shore D) | 59 | 57 | 59 | 59 | 49 | 46 |
| Intermediate layer | Material | No. 1 | No. 1 | No. 1 | No. 2 | No. 1 | No. 1 |
| | Thickness (mm) | 1.21 | 1.23 | 1.21 | 1.21 | 1.22 | 1.23 |
| | Weight (g) | 5.8 | 5.8 | 5.8 | 5.8 | 5.8 | 5.8 |
| | Material hardness (sheet hardness: Shore D) | 64 | 64 | 64 | 66 | 64 | 64 |
| Intermediate layer-encased sphere | Diameter (mm) | 41.07 | 41.09 | 41.07 | 41.07 | 41.07 | 41.09 |
| | Weight (g) | 40.75 | 40.77 | 40.75 | 40.75 | 40.75 | 40.77 |
| | Deflection (mm) | 2.55 | 2.68 | 2.55 | 2.50 | 2.50 | 2.73 |
| | Surface hardness (Shore D) | 70 | 70 | 70 | 72 | 70 | 70 |
| Cover | Material | No. 3 | No. 3 | No. 3 | No. 3 | No. 3 | No. 3 |
| | Thickness (mm) | 0.82 | 0.80 | 0.82 | 0.82 | 0.82 | 0.80 |
| | Weight (g) | 4.7 | 4.6 | 4.7 | 4.7 | 4.7 | 4.6 |
| | Material hardness (sheet hardness: Shore D) | 47 | 47 | 47 | 47 | 47 | 47 |
| Paint film layer | Type | I | I | I | I | I | I |
| | Hardness (Hc) | 63 | 63 | 63 | 63 | 63 | 63 |
| Ball | Diameter (mm) | 42.72 | 42.70 | 42.72 | 42.72 | 42.72 | 42.70 |
| | Weight (g) | 45.5 | 45.5 | 45.5 | 45.5 | 45.5 | 45.5 |
| | Deflection (Q) (mm) | 2.44 | 2.84 | 2.44 | 2.40 | 2.40 | 2.88 |
| | Surface hardness (Shore D) | 60 | 60 | 60 | 62 | 60 | 60 |
| Dimples | | Family A | Family B | Family A | Family A | Family A | Family A |
| Ball surface hardness − Surface hardness of intermediate layer-encased sphere (Shore D) | | −10 | −10 | −10 | −10 | −10 | −10 |
| Ball surface hardness − Core surface hardness (Shore D) | | 1 | 3 | 1 | 3 | 11 | 14 |
| Intermediate layer thickness − Cover thickness (mm) | | 0.43 | 0.39 | 0.39 | 0.39 | 0.39 | 0.43 |
| Intermediate layer weight − Cover weight (g) | | 1.1 | 1.2 | 1.1 | 1.1 | 1.1 | 1.2 |
| Difference in deflection (P − Q) (mm) | | 0.74 | 0.90 | 0.74 | 0.78 | 0.70 | 0.95 |
| Cm − Hc (Hardness at core midpoint − Coating hardness) | | 5.5 | 1.6 | 5.5 | 5.5 | 8.8 | 6.3 |

| | | | Comparative Example | | | | |
|---|---|---|---|---|---|---|---|
| | | | 3 | 4 | 5 | 6 | 7 |
| Construction | | | 3-piece | 3-piece | 3-piece | 3-piece | 3-piece |
| Core | Diameter (mm) | | 38.64 | 38.64 | 38.7 | 38.7 | 37.7 |
| | Weight (g) | | 34.99 | 34.99 | 35.1 | 35.1 | 32.9 |
| | Specific gravity (g/mm$^3$) | | 1.158 | 1.158 | 1.156 | 1.156 | 1.173 |
| | Deflection (P) (mm) | | 3.0 | 3.5 | 3.3 | 3.4 | 3.2 |
| Core hardness | Surface hardness (Cs) | | 90.2 | 86.8 | 93.0 | 92.0 | 80.0 |
| | Hardness 15 mm from center (C15) | | 83.8 | 78.8 | 77.5 | 77.5 | 72.5 |

TABLE 6-continued

| | | | | | | |
|---|---|---|---|---|---|---|
| profile | Hardness 12.5 mm from center (C12.5) | 75.5 | 69.3 | 69.8 | 68.3 | 60.5 |
| | Hardness 10 mm from center (C10) | 68.7 | 64.2 | 69.0 | 67.0 | 63.0 |
| | Hardness 7.5 mm from center (C7.5) | 68.3 | 63.6 | 68.8 | 66.8 | 60.8 |
| | Hardness 5 mm from center (C5) | 67.5 | 63.7 | 67.5 | 65.0 | 59.0 |
| | Hardness 2.5 mm from center (C2.5) | 65.7 | 62.7 | 65.5 | 63.3 | 57.3 |
| | Center hardness (Cc) | 64.1 | 61.7 | 63.0 | 62.0 | 55.0 |
| | Hardness 7.5 mm toward core surface side from midpoint M ($C_{M+7.5}$) | 87.0 | 82.8 | 89.5 | 89.5 | 75.4 |
| | Hardness 5 mm toward core surface side from midpoint M ($C_{M+5}$) | 82.7 | 77.5 | 73.0 | 73.7 | 74.0 |
| | Hardness 2.5 mm toward core surface side from midpoint M ($C_{M+2.5}$) | 74.6 | 68.6 | 69.0 | 67.0 | 57.2 |
| | Hardness at midpoint M ($C_M$) | 68.7 | 64.1 | 69.0 | 67.0 | 62.4 |
| | Hardness 2.5 mm toward core center side from midpoint M ($C_{M-2.5}$) | 68.2 | 63.6 | 68.6 | 66.6 | 60.5 |
| | Hardness 5 mm toward core center side from midpoint M ($C_{M-5}$) | 67.3 | 63.6 | 67.3 | 64.7 | 58.4 |
| | Hardness 7.5 mm toward core center side from midpoint M ($C_{M-7.5}$) | 65.5 | 62.5 | 65.2 | 63.1 | 57.0 |
| | Surface hardness − Center hardness (Cs − Cc) | 26.1 | 25.2 | 30.0 | 30.0 | 25.0 |
| | Surface area A: 1/2 × 2.5 × ($C_{M-5}$ − $C_{M-7.5}$) | 2.2 | 1.3 | 2.7 | 2.0 | 1.8 |
| | Surface area B: 1/2 × 2.5 × ($C_{M-2.5}$ − $C_{M-5}$) | 1.1 | 0.1 | 1.6 | 2.4 | 2.5 |
| | Surface area C: 1/2 × 2.5 × ($C_M$ − $C_{M-2.5}$) | 0.6 | 0.6 | 0.5 | 0.5 | 2.5 |
| | Surface area D: 1/2 × 2.5 × ($C_{M+2.5}$ − $C_M$) | 7.4 | 5.6 | 0.0 | 0.0 | −6.5 |
| | Surface area E: 1/2 × 2.5 × ($C_{M+5}$ − $C_{M+2.5}$) | 10.2 | 11.1 | 5.0 | 8.4 | 20.9 |
| | Surface area F: 1/2 × 2.5 × ($C_{M+7.5}$ − $C_{M+5}$) | 5.4 | 6.7 | 20.6 | 19.7 | 1.8 |
| | Surface areas A + B + C | 4.0 | 1.9 | 4.8 | 4.9 | 6.8 |
| | Surface areas D + E | 17.5 | 16.7 | 5.0 | 8.4 | 14.4 |
| | Surface areas D + E + F | 22.9 | 23.4 | 25.6 | 28.1 | 16.2 |
| | (Surface areas D + E + F) − (Surface areas A + B + C) | 18.9 | 21.4 | 20.8 | 23.2 | 9.4 |
| | (Surface areas D + E) − (Surface areas A + B + C) | 13.6 | 14.8 | 0.2 | 3.5 | 7.6 |
| | [(Surface areas D + E + F) − (Surface areas A + B + C)]/(Cs − Cc) | 0.73 | 0.85 | 0.69 | 0.77 | 0.38 |
| | Surface areas D − C | 6.8 | 5.0 | −0.5 | −0.5 | −−9.0 |
| | Surface areas E − D | 2.8 | 5.5 | 5.0 | 8.4 | 27.4 |
| | Surface areas C − B | −0.5 | 0.5 | −1.1 | −1.9 | 0.0 |
| | Surface hardness (Shore D) | 57 | 56 | 58 | 57 | 48 |
| Intermediate layer | Material | No. 1 | No. 1 | No. 1 | No. 1 | No. 1 |
| | Thickness (mm) | 1.22 | 1.22 | 1.20 | 1.20 | 1.70 |
| | Weight (g) | 5.8 | 5.8 | 5.7 | 5.7 | 7.9 |
| | Material hardness (sheet hardness: Shore D) | 64 | 64 | 64 | 64 | 64 |
| Intermediate layer-encased sphere | Diameter (mm) | 41.08 | 41.08 | 41.1 | 41.1 | 41.1 |
| | Weight (g) | 40.76 | 40.76 | 40.8 | 40.8 | 40.8 |
| | Deflection (mm) | 2.30 | 2.63 | 2.58 | 2.61 | 2.60 |
| | Surface hardness (Shore D) | 70 | 70 | 70 | 70 | 70 |
| Cover | Material | No. 3 | No. 3 | No. 3 | No. 3 | No. 3 |
| | Thickness (mm) | 0.81 | 0.81 | 0.80 | 0.80 | 0.80 |
| | Weight (g) | 4.7 | 4.7 | 4.6 | 4.6 | 4.6 |
| | Material hardness (sheet hardness: Shore D) | 47 | 47 | 47 | 47 | 47 |
| Paint film layer | Type | I | I | I | I | I |
| | Hardness (Hc) | 63 | 63 | 63 | 63 | 63 |
| Ball | Diameter (mm) | 42.70 | 42.70 | 42.70 | 42.70 | 42.70 |
| | Weight (g) | 45.5 | 45.5 | 45.5 | 45.5 | 45.5 |
| | Deflection (Q) (mm) | 2.31 | 2.80 | 2.46 | 2.65 | 2.40 |
| | Surface hardness (Shore D) | 60 | 60 | 60 | 60 | 60 |
| Dimples | | Family A | Family A | Family A | Family A | Family A |
| Ball surface hardness − Surface hardness of intermediate layer-encased sphere (Shore D) | | −10 | −10 | −10 | −10 | −10 |
| Ball surface hardness − Core surface hardness (Shore D) | | 3 | 4 | 2 | 3 | 12 |
| Intermediate layer thickness − Cover thickness (mm) | | 0.42 | 0.42 | 0.40 | 0.40 | 0.90 |
| Intermediate layer weight − Cover weight (g) | | 1.1 | 1.1 | 1.1 | 1.1 | 3.2 |
| Difference in deflection (P − Q) (mm) | | 0.67 | 0.69 | 0.84 | 0.75 | 0.80 |
| Cm − Hc (Hardness at core midpoint − Coating hardness) | | 5.7 | 1.1 | 6.0 | 4.0 | −0.6 |

The flight performance (W #1) and controllability of each golf ball were evaluated by the following methods. The results are shown in Table 7.

Flight Performance (1)

A driver (W #1) was mounted on a golf swing robot and the distance traveled by the ball when struck at a head speed of 45 m/s was measured and rated according to the criteria shown below. The club used was the TourB XD-5 Driver (loft angle, 9.5°) manufactured by Bridgestone Sports Co., Ltd. In addition, using an apparatus for measuring the initial conditions, the spin rate was measured immediately after the ball was similarly struck.

Rating Criteria

Good: Total distance was 228.0 m or more

NG: Total distance was less than 228.0 m

Flight Performance (2)

A number six iron (I #6) was mounted on a golf swing robot and the distance traveled by the ball when struck at a head speed of 40 m/s was measured and rated according to the criteria shown below. The club used was the TourB X-CB, a number six iron manufactured by Bridgestone Sports Co., Ltd. In addition, using an apparatus for measuring the initial conditions, the spin rate was measured immediately after the ball was similarly struck.

Rating Criteria

Good: Total distance was 162.0 m or more

NG: Total distance was less than 162.0 m

Controllability on Approach Shots

A sand wedge (SW) was mounted on a golf swing robot and the amount of spin by the ball when struck at a head speed of 20 m/s was rated according to the criteria shown below. The club was the TourB XW-1, a sand wedge manufactured by Bridgestone Sports Co., Ltd.

Rating Criteria:

Good: Spin rate was 6,000 rpm or more

NG: Spin rate was less than 6,000 rpm

TABLE 7

| | | Working Example | | | | Comparative Example | | | | | | |
|---|---|---|---|---|---|---|---|---|---|---|---|---|
| | | 1 | 2 | 3 | 4 | 1 | 2 | 3 | 4 | 5 | 6 | 7 |
| Right (W#1) HS, 45 m/s | Spin rate (rpm) | 2,646 | 2,536 | 2,636 | 2,612 | 2,789 | 2,637 | 2,775 | 2,666 | 2,763 | 2,685 | 2,601 |
| | Total distance (m) | 229.5 | 228.6 | 229.1 | 230.2 | 227.1 | 226.2 | 227.9 | 227.5 | 227.6 | 227.8 | 226.3 |
| | Rating | Good | Good | Good | Good | NG | NG | NG | NG | NG | NG | NG |
| Flight (I#6) HS, 40 m/s | Spin rate (rpm) | 5,150 | 4,832 | 5,152 | 5,015 | 5,432 | 5,130 | 5,286 | 4,962 | 5,185 | 5,039 | 4,881 |
| | Total distance (m) | 163.7 | 166.1 | 164.1 | 164.0 | 161.1 | 164.0 | 162.5 | 164.8 | 163.1 | 163.8 | 164.5 |
| | Rating | Good | Good | Good | Good | NG | Good | Good | Good | Good | Good | Good |
| Controllability on approach shots | Spin rate (rpm) | 6,233 | 6,236 | 6,199 | 6,121 | 6,243 | 6,205 | 6,243 | 6,221 | 6,287 | 6,251 | 6,199 |
| | Rating | Good | Good | Good | Good | Good | Good | Good | Good | Good | Good | Good |

As demonstrated by the results in Table 7, the golf balls of Comparative Examples 1 to 7 were inferior in the following respects to the golf balls according to the present invention that were obtained in the Working Examples.

The ball obtained in Comparative Example 1 had a core hardness profile in which the Shore C hardness difference between the core surface and the core center (Cs−Cc) was not at least 27. As a result, the ball had an increased spin rate and a good distance was not achieved.

The ball obtained in Comparative Example 2 had a core hardness profile in which the Shore C hardness difference between the core surface and the core center (Cs−Cc) was not at least 27 and which did not satisfy the expression (surface areas D+E)−(surface areas A+B+C)≥1. As a result, the initial velocity of the ball when struck was low and a good distance was not achieved.

In Comparative Example 3, the Shore C hardness difference between the core surface and the core center (Cs−Cc) was not at least 27. As a result, the ball had an increased spin rate and a good distance was not achieved.

In Comparative Example 4, the Shore C hardness difference between the core surface and the core center (Cs−Cc) was not at least 27. As a result, the ball had an increased spin rate and the initial velocity of the ball when struck was low, and so a good distance was not achieved.

In Comparative Example 5, the ball did not satisfy the expression (surface areas D+E)−(surface areas A+B+C)≥1 and the relationship; surface area C<surface area D<surface area E. As a result, the ball had an increased spin rate and a good distance was not achieved.

In Comparative Example 6, the ball did not satisfy the relationship; surface area C<surface area D<surface area E. As a result, the initial velocity of the ball when struck was low and a good distance was not achieved.

In Comparative Example 7, the Shore C hardness difference between the core surface and the core center (Cs−Cc) was not at least 27. As a result, the initial velocity of the ball when struck was low and a good distance was not achieved.

Japanese Patent Application No. 2018-094620 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising a core, an intermediate layer and a cover, wherein the sphere obtained by encasing the core with the intermediate layer (intermediate layer-encased sphere) has a higher surface hardness than the ball; and the core has a hardness profile in which, letting Cc be the Shore C hardness at a center of the core and Cs be the Shore C hardness at the core surface, the hardness difference between the core surface and center (Cs−Cc), expressed in terms of Shore C hardness, is at least 27 and, letting $C_M$ be the Shore C hardness at a midpoint M between the core center and surface, $C_{M+2.5}$, $C_{M+5.0}$ and $C_M$+7.5 be the Shore C hardnesses at, respectively, positions 2.5 mm, 5.0 mm and 7.5 mm from the midpoint M toward the core surface side, and $C_{M-2.5}$, $C_{M-5.0}$ and $C_{M-7.5}$ be the Shore C hardnesses at, respectively, positions 2.5 mm, 5.0 mm and 7.5 mm from the midpoint M toward the core center side, the surface areas A to F defined as follows $$\text{surface area } A\text{: } \tfrac{1}{2}\times 2.5\times(C_{M-5.0}-C_{M-7.5}),$$

$$\text{surface area } B\text{: } \tfrac{1}{2}\times 2.5\times(C_{M-2.5}-C_{M-5.0}),$$

$$\text{surface area } C\text{: } \tfrac{1}{2}\times 2.5\times(C_{M}-C_{M-2.5}),$$

surface area $D$: $\frac{1}{2}\times 2.5\times(C_{M+2.5}-C_M)$, surface area $E$: $\frac{1}{2}\times 2.5\times(C_{M+5.0}-C_{M+2.5})$, surface area $F$: $\frac{1}{2}\times 2.5\times(C_{M+7.5}-C_{M+5.0})$, satisfy the conditions (surface area $D$+surface area $E$)−(surface area $A$+surface area $B$+surface area $C$)≥1, and surface area $C$<surface area $D$<surface area $E$.

2. The golf ball of claim 1, wherein the surface areas A to F in the core hardness profile satisfy the condition (surface area $D$+surface area $E$+surface area $F$)−(surface area $A$+surface area $B$+surface area $C$)≥10.

3. The golf ball of claim 1, wherein the surface areas A to F in the core hardness profile satisfy the condition 0.40≤[(surface area $D$+surface area $E$+surface area $F$)−(surface area $A$+surface area $B$+surface area $C$)]/($Cs-Cc$)≤0.85.

4. The golf ball of claim 1, wherein the surface areas B to E in the core hardness profile satisfy the condition surface area $B$<surface area $C$<surface area $D$<surface area $E$.

5. The golf ball of claim 1, wherein the core is a single layer made of a rubber material.

6. The golf ball of claim 1, wherein a paint film layer is formed on the cover surface and, letting Hc be the Shore C hardness of the paint film layer, the difference between the Shore C hardness $C_M$ at the midpoint M between the core center and surface and Hc ($C_M$−Hc) is 0 or more.

7. The golf ball of claim 1, wherein the cover has a plurality of dimples formed on a surface thereof, the ball has arranged thereon at least one dimple with a cross-sectional shape that is described by a curved line or a combination of straight and curved lines and specified by steps (i) to (iv) below, and the total number of dimples is from 250 to 380:

(i) letting the foot of a perpendicular drawn from a deepest point of the dimple to an imaginary plane defined by a peripheral edge of the dimple be the dimple center and a straight line that passes through the dimple center and any one point on the edge of the dimple be the reference line;

(ii) dividing a segment of the reference line from the dimple edge to the dimple center into at least 100 points and computing the distance ratio for each point when the distance from the dimple edge to the dimple center is set to 100%;

(iii) computing the dimple depth ratio at every 20% from 0 to 100% of the distance from the dimple edge to the dimple center; and (iv) at the depth ratios in dimple regions 20 to 100% of the distance from the dimple edge to the dimple center, determining the change in depth ΔH every 20% of said distance and designing a dimple cross-sectional shape such that the change ΔH is at least 6% and not more than 24% in all regions corresponding to from 20 to 100% of said distance.

* * * * *